US005699925A

United States Patent [19]

Petruzzi

[11] Patent Number: 5,699,925

[45] Date of Patent: Dec. 23, 1997

[54] INTERLOCKING STACKABLE CONTAINER STORAGE SYSTEM

[76] Inventor: Thomas G. Petruzzi, 5118 Belleville Ave., Orlando, Fla. 32812

[21] Appl. No.: 649,136

[22] Filed: May 14, 1996

[51] Int. Cl.[6] ..... B65D 21/036

[52] U.S. Cl. ..... 220/4.27; 206/508; 206/509; 206/511; 206/512

[58] Field of Search ..... 220/4.27, 4.26, 220/4.21, 4.22, 4.23, 23.6, 338; 206/508, 509, 511, 512

[56] References Cited

U.S. PATENT DOCUMENTS

| | | | |
|---|---|---|---|
| 2,733,830 | 2/1956 | Ruskin . | |
| 2,746,081 | 5/1956 | Gershen . | |
| 3,077,282 | 2/1963 | Eggers . | |
| 3,285,464 | 11/1966 | Boydman . | |
| 3,315,796 | 4/1967 | Dreyfuss . | |
| 3,376,046 | 4/1968 | Kivett et al. | 206/508 |
| 3,381,844 | 5/1968 | Sieve . | |
| 3,405,836 | 10/1968 | Regis, Jr. . | |
| 4,109,821 | 8/1978 | Lutz . | |
| 4,302,866 | 12/1981 | Irvin . | |
| 4,401,312 | 8/1983 | Parker . | |
| 4,431,114 | 2/1984 | Kleinfeld . | |
| 4,844,263 | 7/1989 | Hadtke | 206/508 |
| 5,062,539 | 11/1991 | Chandler | 206/508 |
| 5,096,084 | 3/1992 | Wells . | |
| 5,312,011 | 5/1994 | Fischer | 206/508 |

FOREIGN PATENT DOCUMENTS

| | | |
|---|---|---|
| 2428576 | 2/1980 | France . |
| 100022 | 11/1961 | Netherlands . |
| 1178157 | 1/1970 | United Kingdom . |
| 1563097 | 3/1980 | United Kingdom . |

*Primary Examiner*—Stephen J. Castellano

*Attorney, Agent, or Firm*—Allen, Dyer, Doppelt, Milbrath & Gilchrist, P.A.

[57] ABSTRACT

A portable plastic container has a tapered tongue on a lid top wall arranged for positioning within a tapered groove of a similar container bottom wall for vertically stacking a selected quantity of containers in an interlocking arrangement. Interlocking the containers permits opening of any container without the need foe rearranging and restacking. For interlocking one container to another, the bottom groove of one container is forced into the top tongue of a similar container. A snapping sound is heard as the tongue passes through a slightly smaller groove opening to its seated position within the groove, thus providing seating feedback and assurance to the user that the containers are properly interlocked.

22 Claims, 5 Drawing Sheets

INTERLOCKING STACKABLE CONTAINER STORAGE SYSTEM

BACKGROUND OF INVENTION

1. Field of Invention

The invention relates generally to portable, stackable containers as used for storing lightweight objects, and more particularly to a vertically stackable container interlockable with similar adjacent containers.

2. Description of Background Art

Small articles typically used at home or work are often received in packages unsuitable for storage. Such articles are loosely stored in draws or boxes, within which the article was purchased, that are not conducive to organized storage and do not provide easy access when the article is needed. Containers having partitioned sections and modular container units dimensioned for easy arrangement and use have proven to be effective in the organizing and storage of such loosely arranged articles. In particular, self stacking plastic containers of varying styles and construction have proven to be effective in organizing and storing such articles as cosmetics, fishing lures, kitchen products, and food products. However, the typical stackable container, although stackable, is easily separated from its container matching set or system. Further, in order to access a stored article, the stacked containers are rearranged in selecting the container housing the article so that the selected container can be opened. Organizing and rearranging the containers into their original configuration is then needed.

SUMMARY OF INVENTION

It is a primary object of the present invention to provide a storage system for small articles. It is further an object to provide a container that will stack and interlock with similar containers to form the storage system. It is yet another object of the invention to provide an interlocking mechanism that is economical to produce and easy to use. It is further an object of the invention to provide the interlocking mechanism such that one container within the connected system of containers can be opened without the need to separate any one container from the system while having to access an article stored therein.

To meet the objects of the present invention, a container operable within a storage system having similar containers interlockable in a vertically stacked configuration is described. The storage system is useful in organizing and storing of small articles. Each container within the system comprises opposing top and bottom walls. An upwardly projecting tongue extends from one of the container walls. The tongue has outwardly diverging side walls terminating in a tongue edge portion. A cavity lies within the opposing container wall and has opposing side walls converging toward a cavity opening for receiving the tongue of an adjoining similar container therethrough for attaching the tongue within the cavity. The cavity side walls are generally aligned with and cooperate with the tongue side walls in an interlocking fashion while the tongue is positioned within the cavity. The cavity opening is slightly smaller than the tongue edge portion, and requires that the tongue or cavity, or both, be formed from material sufficiently flexible for permitting the tongue edge portion from the adjoining container to be forced through the cavity opening for positioning the tongue within the cavity, thus interlocking the containers in a vertically stacked position.

A snapping sound is heard by a user when the tongue edge portion is forced past the cavity opening for indicating placement of the tongue to its seated position within the cavity. Such a sound provides verification of the interlocked arrangement between the adjoining containers and assurance to the user that the containers forming the system are securely attached. With such assurance, the containers forming the system can be stored or access to one container within the system can be achieved by lifting a lid from the selected container without rearranging or dissembling the system.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
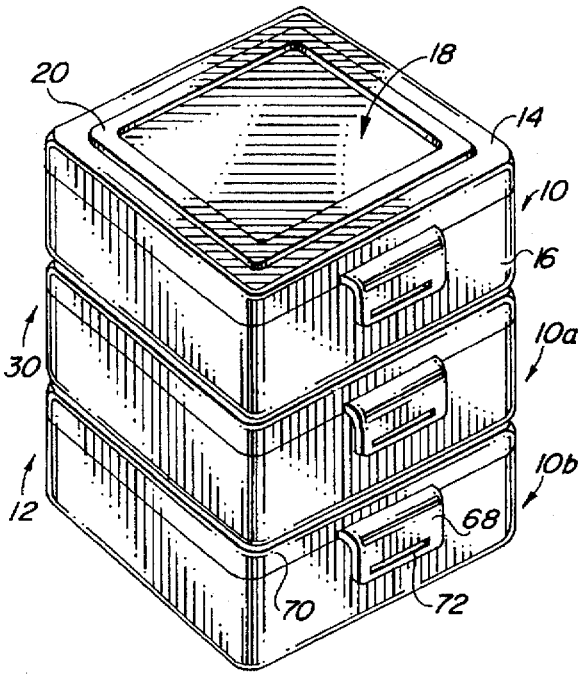
FIG. 1 is a top left perspective view of an embodiment of the present invention illustrating stackable containers in an interlocked arrangement.
Figure 3:
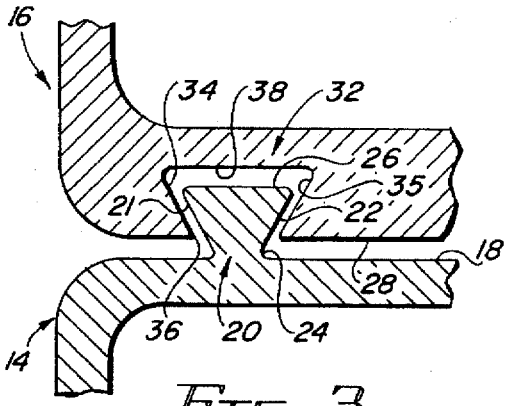
FIG. 3 is a partial cross-sectional view of a tongue and groove of interlocking containers.
Figure 4:
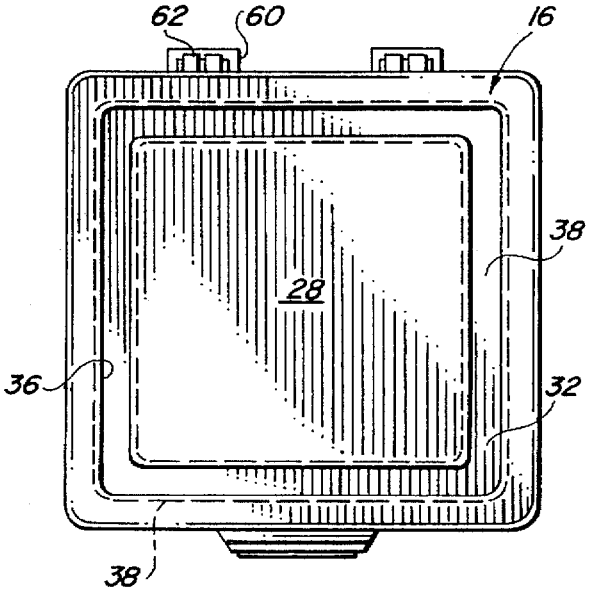
FIG. 4 is a bottom plan view of the container of FIG. 2, illustrating a groove formed within a container hollow body bottom wall configured for interlocking with a similar container in a vertically stacked arrangement.

Referring now to FIG. 1, a portable container 10 useful with other similar containers 10*a*, 10*b* for arranging within a stackable interlocked arrangement 12 comprises a lid 14 and a hollow body 16. A lid top wall 18 has a tongue 20 integrally formed with and extending upwardly from the top wall 18. As further illustrated with reference to FIGS. 2 and 3, the tongue 20 has outwardly tapering opposing side walls 21, 22 starting from a narrow neck portion 24 and terminating in a tongue edge portion 26. The hollow body 16 in the preferred embodiment herein described, has a bottom wall 28 which opposes the lid top wall 18 when the container 10 is in a closed position 30, as the containers of FIG. 1 illustrate. With reference to FIG. 4, the body bottom wall 28 has a cavity formed as a groove 32 positioned and sized for receiving a tongue 20 within the lid 14 of a similar adjoining container 10.

By way of example, and as illustrated with reference to FIG. 1, a container 10 will have a lid 14, a body 16, while a container 10a will have a lid 14*a* and a body 16*a* and so on. For discussion, reference will be made to the elements by their numerals without the suffix letter added unless clarification and emphasis is needed.

Again with reference to FIGS. 3 and 4, the groove 32 has opposing side walls 34, 35 converging toward a groove opening 36 from a groove seat 38 for receiving the tongue 20 of a similar container 10 therethrough. The groove opposing side walls 34, 35 generally cooperate with the tongue side walls 21, 22 in dovetail fashion when the tongue 20 of an adjoining container 10 is within its groove 32. As illustrated again with reference to FIG. 3, the groove opening 36 is slightly smaller than the tongue edge portion 26. As will be herein described for the preferred embodiment, the tongue 20 is continuously formed about a peripheral portion of the top wall 18 and the groove 32 is likewise formed within along a periphery of the body bottom wall 28 for aligning container side walls 11 of the similar, interlocking, vertically stacked containers 10, 10*a*, 10*b*.

In the preferred embodiment of the present invention, the container 10, is molded from a plastic material sufficiently flexible for permitting the tongue edge portion 26 from the similar container 10 to be forced through the groove opening 36 for seating therein. It is anticipated that containers 10 will have a flexible plastic wall construction as illustrated with reference to FIG. 3 or a thin wall construction as illustrated with reference to FIG. 5. Further, it is anticipated that containers 10 will be sized for convenience, typically for holding in a hand of a user for storage of small objects as earlier described to those requiring both hands to carry larger objects. In any case, it is the flexibility in the tapered tongue and groove combination that is sought for permitting passage of the larger tongue edge past the smaller groove opening for seating the tongue within the groove and thus interlocking the similar adjoining vertically stacked containers. The description made with reference to FIG. 3 is appropriate with reference to FIG. 5 as well.

Figure 5:
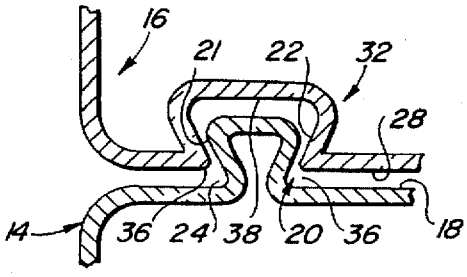
FIG. 5 is a partial cross-sectional view of a tongue and groove of interlocking containers having an alternate thin wall construction.

The groove 32 is arranged for engaging the tongue 20 of the similar container 10*a*, as described earlier with reference to FIG. 1, and as illustrated with reference to FIGS. 3 and 5, for interlocking the containers 10, 10*a* in the vertically stacked arrangement 12 when the containers 10, 10*a*, 10*c* are in a closed position 30 and during operation of the containers 10 to their open position as will be later described.

Hinge means 40 are operatively connected between the lid 14 and the body 16 as illustrated with reference to FIG. 6 and for an alternate hinge 42 as illustrated with reference to FIG. 7. The hinges 40, 42 as is well known connect the lid 14 and body 16 when operating the container from a closed position 30 to an open position 44 as is further illustrated with reference to FIGS. 8 and 9.

Figure 9:
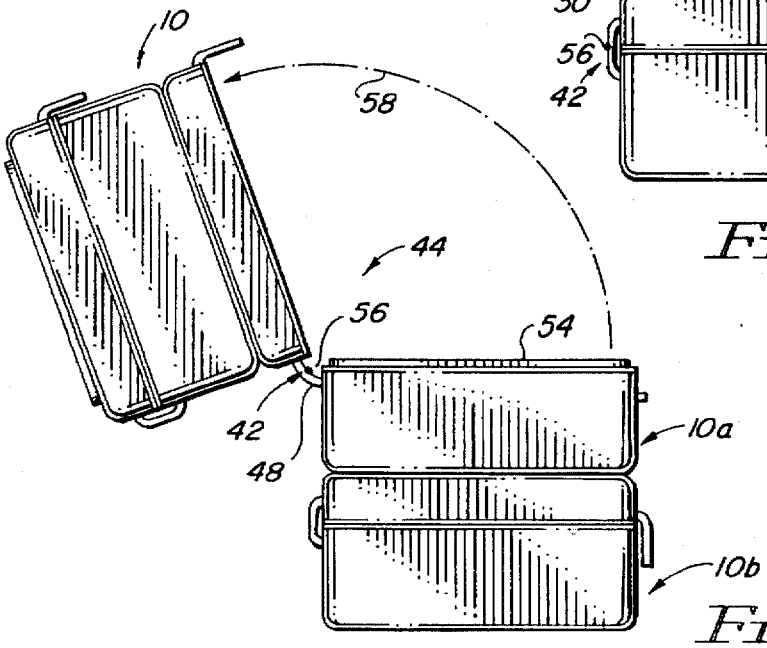
FIG. 9 is a side elevational view of the similar containers of FIG. 5, illustrating one container in an open position.
Figure 10:
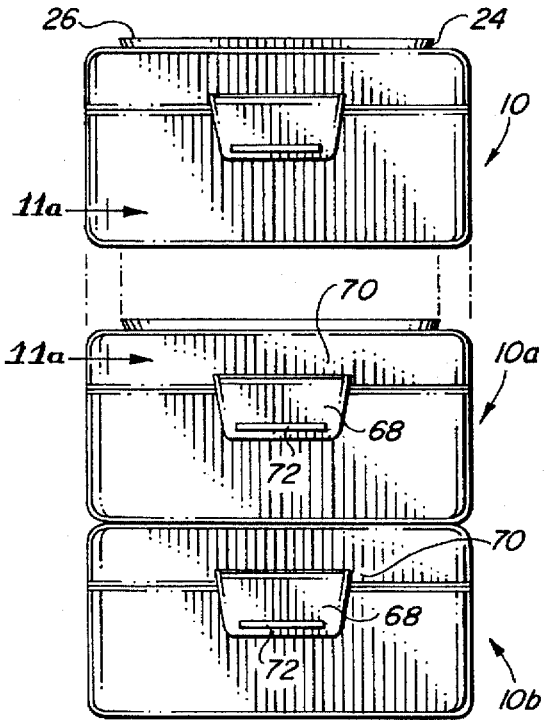
FIG. 10 is a front elevational exploded view illustrating stacking of containers in an embodiment of the present invention.
Figure 11A:
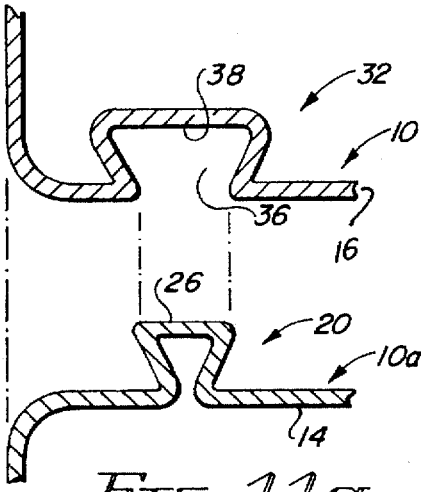
FIG. 11*a* is a partial cross-sectional view of a tongue of one container approaching a groove of another container for positioning the tongue within the groove, and thus interlocking the containers.
Figure 11B:
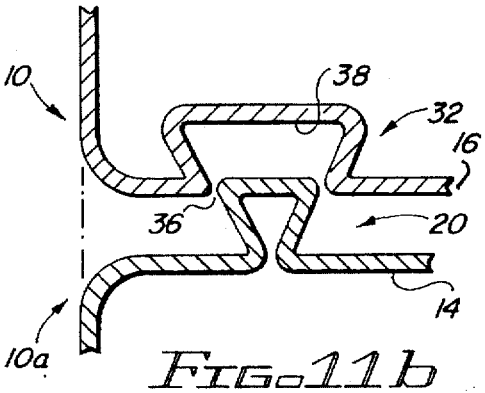
FIG. 11*b* is the tongue and groove of FIG. 11*a* illustrating a flexible tongue and groove arrangement for passing a tongue edge portion through a slightly smaller groove opening for interlocking the tongue into the groove.
Figure 12:
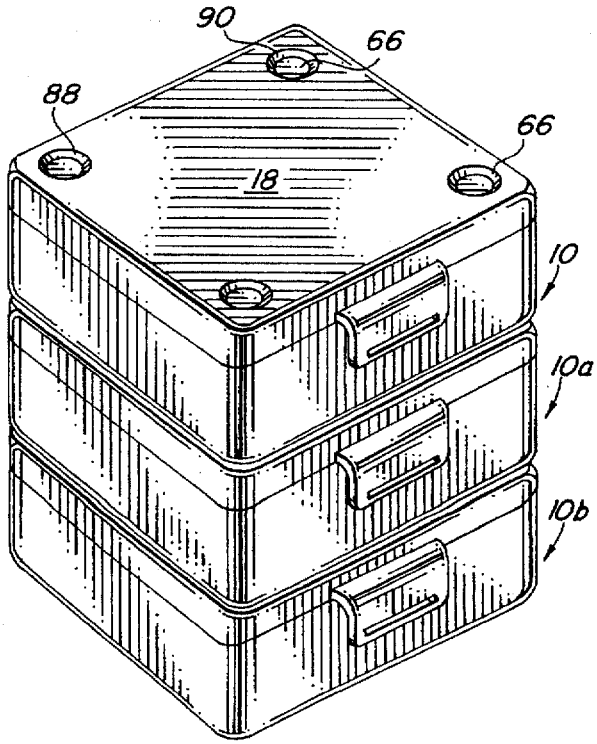
FIG. 12 is a top left perspective view of yet another embodiment of the present invention illustrating stackable containers in an interlocked arrangement.
Figure 11C:
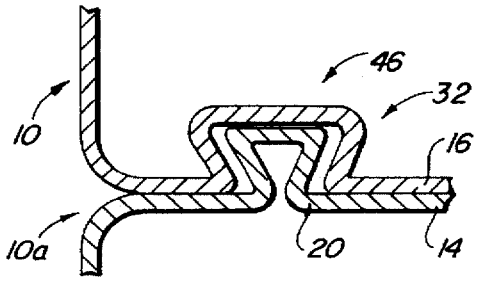
FIG. 11*c* is the tongue and groove of FIG. 11*a* and 11*b* illustrating the tongue and groove after being heard snapping into a dovetail styled position in the interlocking arrangement.
Figure 13:
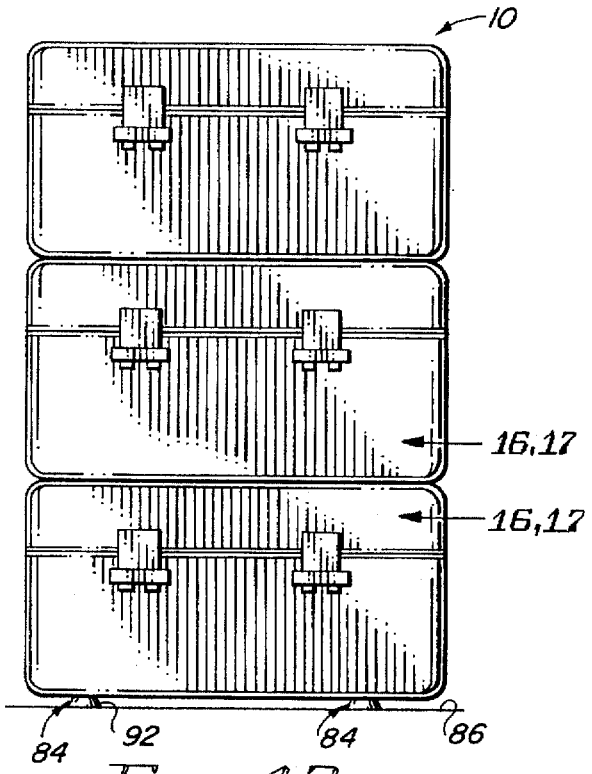
FIG. 13 is a rear elevational view of the embodiment of FIG. 12.

During operation and use of the containers 10, a stacked arrangement 12 as illustrated with reference to FIG. 1 will be completed by vertically stacking each container 10, 10*a*, 10*b* and other containers as desired by aligning one container 10 over another 10*a* as illustrated with reference to FIG. 10 and forcing the groove 32 in the body bottom wall 28 into interlocking arrangement as described and as illustrated again with reference to FIG. 8. With such an tongue 20 and groove 32 interlocked position as described, it is possible to open one container 10*a*without rearranging or disconnecting any other stacked container 10, 10*b* as illustrated in the open position 40 of FIG. 9. With reference now to FIGS. 11*a*–11*c*, to provide assurance to a user that adjoining containers have been interlocked, seating feedback means are provided by a snapping type sound heard by a user when the tongue edge portion 26 is forced past the groove opening 36, FIG. 11*b* to FIG. 11*c*, for indicating placement of the tongue 20 to its seated position 46 within the groove 32. With such a snapping sound, assurance of the interlocked arrangement between the adjoining containers is provided to the user.

Figure 7:
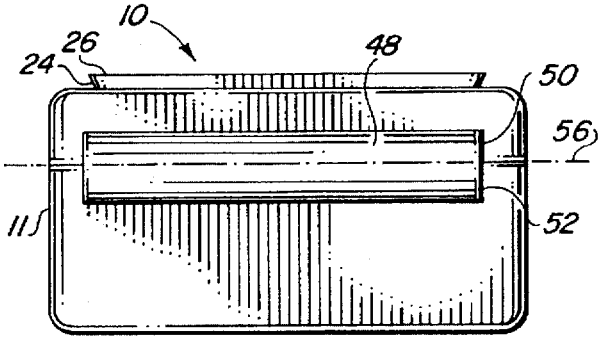
FIG. 7 is a rear elevational view of an alternate embodiment of a container of FIG. 1 illustrating hinge means having a continuous flexible member.
Figure 8:
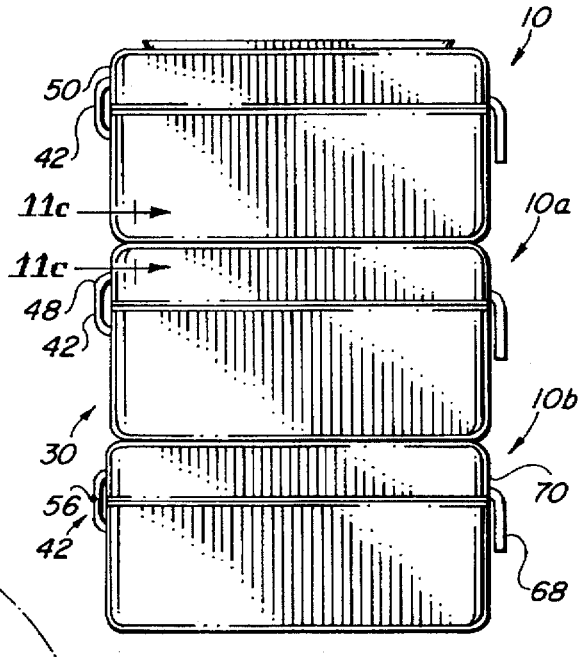
FIG. 8 is a side elevational view of similar containers in a closed position interlocked in a vertically stacked arrangement.

Again with reference to FIGS. 7–9, the alternate embodiment of hinge means 40 comprises a continuous flexible hinge 42 wherein a hinge member 48 is attached between a lid side wall portion 50 and a body cooperating side wall portion 52 for permitting the lid 14 to rotate from the closed container position 30 to the open position 44, wherein the lid 14 extends beyond the body opening 54 as illustrated again with reference to FIGS. 8 and 9. The interlocking feature as earlier described thus permits such an open position 44, the lid 14 extending away from the body opening 54, and thus permits access into the hollow body 16 through the opening 54 without interference from the lid 14 and without having to remove or rearrange the stacked containers 10, 10*a*, 10*b*. As illustrated again with reference to FIG. 9, the lid 14, is rotated about a hinge axis of rotation wherein at least one open position passes the lid 14 about an arc 58 of at least ninety degrees about a hinge axis 56. In the embodiment of FIGS. 7–9, it is anticipated that the lid, body and hinge means are integrally formed from a plastic material.

Figure 2:
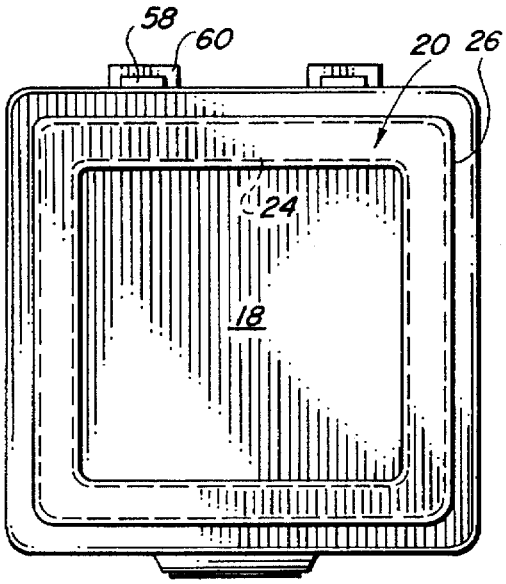
FIG. 2 is a top plan view of a container of FIG. 1 illustrating a tongue continuously formed on a lid.
Figure 6:
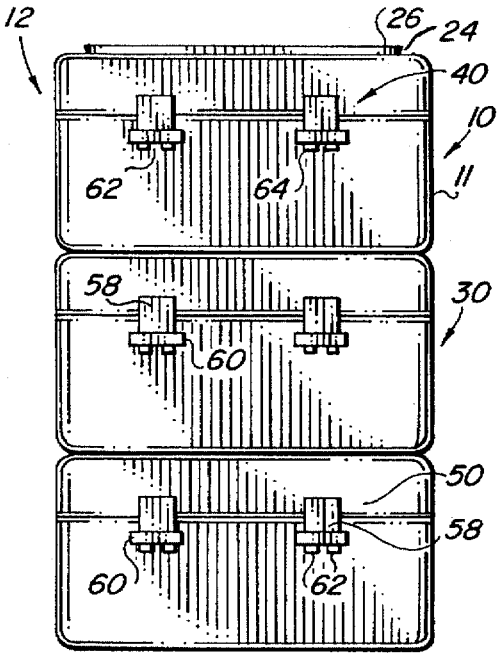
FIG. 6 is a rear elevational view of the embodiment of FIG. 1.

In the embodiment of FIGS. 2, 4, and 6, the hinge means 40 comprises a flap affixed to the lid side wall portion 50 for communicating with a boss 60 extending from the body side wall portion 52. The flap 58 has bifurcated flexible projections 62 extending in longation with the flap 58. Each projection 62 has a hook shape end portion 64 for securing the flap 58 within a boss slot 66. The boss slot 66 loosely receives the flap 58. The projections 62 have the hook shape end portions 64 extending outwardly from the slot over a surface of the boss for securing the flap within the boss. With such a container 10, the lid 14 is separable from the body 16 by squeezing the projections 62 together for permitting the hook portions 64 to pass through the slot 66 for removing a lid 14 and replacing the lid 14 with those having varying characteristics such as differing colors or levels of transparency than does the body 16.

As illustrated, again with reference to FIGS. 1, 2, 4, and 8–10, a clasp 68 extends downwardly from a lid front wall portion 70. The clasp 68 has a slot 72 for receiving a tab 74 extending outwardly from a body front wall portion 76 for securing the lid 14 in the closed position 30. The tab 74 is positioned within the slot 72 for preventing rotation of the lid 14 about the hinge axis 56. It is anticipated that a variety of clasp embodiments will be used with the container 10 to meet use demands.

Figure 16:
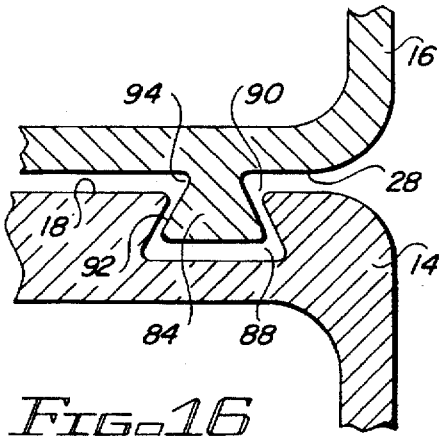
FIG. 16 is a partial cross-sectional view illustrating interlocking elements of the embodiment of FIG. 12.
Figure 14:
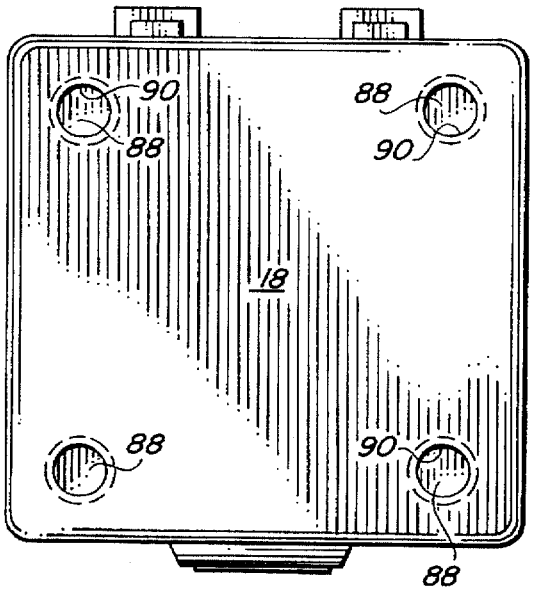
FIG. 14 is a top plan view of the embodiment of FIG. 12.
Figure 15:
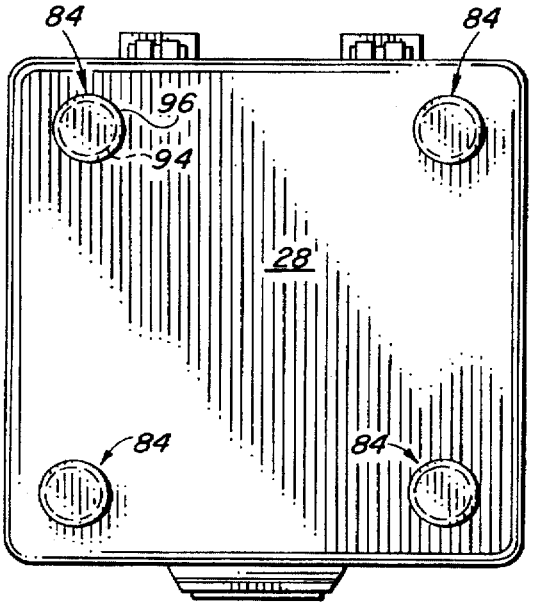
FIG. 15 is a bottom plan view of the embodiment of FIG. 12.
Figure 17:
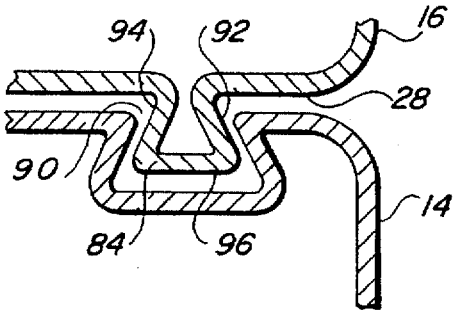
FIG. 17 is a partial cross-sectional view illustrating interlocking elements of the embodiment of FIG. 12 wherein containers include thin wall construction.

With reference to FIGS. 12–15, an alternate embodiment of the present invention comprises a generally cylindrical shaped tongue 84 which in a preferred embodiment extends downwardly from the container body bottom wall 28 and performs as a foot when the container 10 is placed onto a supporting surface 86. Unlike the elongated cavity or groove 32, earlier described with reference to FIGS. 3–5, the embodiment illustrated with reference to FIGS. 12–15, includes a cavity 88 formed as a recessed pocket having an inverted, truncated cone shape in cross-section with a circular opening 90. The lid top wall 18 has the cavity 88 integrally formed with and extending into the top wall 18, as illustrated again with reference to FIG. 14 and to FIGS. 16 and 17. The cylindrical tongue 84 extends outwardly from the bottom wall 28 and includes outwardly tapering side walls 92 starting from a narrow neck portion 94 and terminating in a tongue edge portion 96. The container operation and coupling of adjacent containers 10, **10*a*, 10*b* and their interlocking features are as earlier described, the only difference being the shapes of the tongues 20, 84 and communicating groove 32 and cavity 88, interlocking as in a "socket and ball" styled snap, and as supported by the similarity in cross-sections illustrated with reference to FIGS. 16 and 17, and operation as earlier described with reference to FIGS. 3, 5, and 11*a*–11*c***.

Figure 18A:
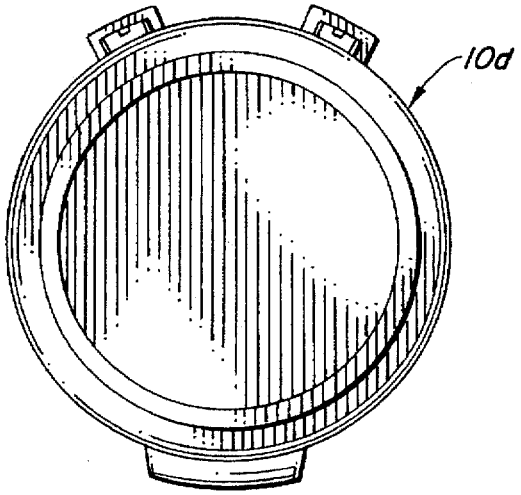
FIG. 18*a*–18*c* are top plan views of containers of the present invention illustrating alternate shapes.
Figure 18B:
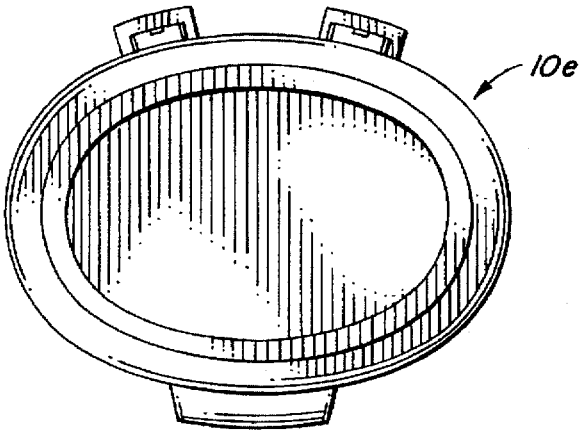
Figure 18C:
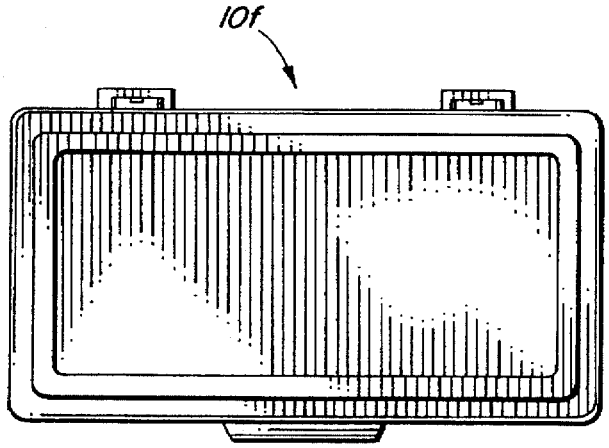

Further, many modifications and other embodiments of the invention will come to the mind of one skilled in the art having the benefit of the teachings presented in the foregoing descriptions and the associated drawings. By way of example, containers 10 will take on various shapes such as illustrated in the circular container **10*d*, oval container 10*e*, and rectangular container 10*f* of FIGS. 18*a*–18*c***. Therefore, it is to be understood that the invention is not to be limited to the specific embodiments disclosed, and that modifications and alternate embodiments are intended to be included within the scope of the appended claims.

What is claimed is:

1. A container operable within a storage system having similar containers interlockable in a vertically stacked configuration, the storage system useful in organizing and storing articles, the container comprising opposing top and bottom walls, wherein an upwardly projecting tongue extends from one of the container walls, the tongue having outwardly diverging side walls terminating in a tongue edge portion, and wherein a cavity within the opposing container wall has opposing side walls converging toward a cavity opening for receiving the tongue of an adjoining similar container therethrough and attaching the tongue within the cavity, the tongue and cavity each formed as an annulus extending proximate peripheral top and bottom wall edge portions, the cavity side walls cooperating with the tongue side walls while the tongue is attached within the cavity, the cavity opening being slightly smaller than the tongue edge portion, the tongue and cavity formed from material sufficiently flexible for permitting the tongue edge portion from the adjoining container to be forced through the cavity opening for positioning the tongue within the cavity, thus coupling the adjoining containers in a vertically stacked and interlocked position.

2. A container according to claim 1, wherein the tongue extends from the container top wall.

3. A container according to claim 1, wherein the tongue extends from the container bottom wall, the tongue forming a foot for supporting the container when positioned upright upon a supporting surface.

4. A container according to claim 1, wherein the top wall forms a portion of a lid and the bottom wall forms a portion of a hollow body, and wherein the lid is hingedly attached to the body.

5. A container according to claim 1, further comprising seating feedback means for providing a snapping type sound when the tongue edge portion is forced past the cavity opening to a seated position, the feedback means indicating placement of the tongue to its seated position within the cavity, thus providing assurance to the user of the interlocked arrangement between the adjoining containers.

6. A portable container useful with other similar containers for arranging within a stackable interlocked configuration, the container comprising:

a lid having a top wall, the top wall having a tongue integrally formed with and extending upwardly from the top wall, the tongue having outwardly tapering opposing side walls terminating in a flexible tongue edge portion;

a hollow body having a bottom wall, the bottom wall opposing the lid top wall while the container is in a closed position, the bottom wall having a groove for receiving a tongue within the lid of a similar adjoining container, the groove having opposing side walls converging toward a groove opening for receiving the tongue therethrough, the groove opposing side walls generally cooperating with the tongue side walls, in dovetail fashion, while the tongue of the adjoining container is within the groove, the groove opening being slightly smaller than the tongue edge portion, the tongue and groove formed from material sufficiently flexible for permitting the tongue edge portion from the similar container to be forced through the groove opening for seating therein, the tongue and groove each formed as an annulus extending proximate peripheral top and bottom wall edge portions the groove arranged for engaging the tongue of the similar container for interlocking the containers in a vertically stacked arrangement when the containers are in a closed position, and during operation of the containers to their open position; and hinge means operatively connected between the lid and body, the hinge means hingedly connecting the lid and body when operating the container from a closed position to an open position.

7. A container according to claim 6, wherein the container is formed from a plastic material.

8. A container according to claim 6, wherein the container is dimensioned for holding in a hand of a user.

9. A container according to claim 6, wherein the hinge means comprises a continuous flexible member attached between the lid and body for permitting the lid to rotate from a closed position extending over the body opening to an open position extending away from the body opening permitting access to the hollow body through the opening, wherein at least one open position passes the lid about an arc of at least ninety degrees about a hinge axis of rotation.

10. A container according to claim 6, wherein the hinge means comprises:

a flap affixed to a lid peripheral portion for communicating with a boss extending from the body, the flap having bifurcated flexible projections extending in longation with flap, each projection having a hook shape end portion for securing the flap within a slot; and a boss extending from a body peripheral portion proximate the body opening, the boss having a slot for loosely receiving the flap, the projections having hook shape end portions extending outwardly for securing the flap within the boss.

11. A container according to claim 6, further comprising:

a clasp extending downwardly from a lid front wall portion, the clasp having means for receiving a tab extending outwardly from the body for securing the lid in the closed position; and a tab extending outwardly from a body front side wall portion, the tab communicating with the clasp receiving means for preventing rotation of the lid about the hinge, thus holding the lid in the closed position.

12. A container according to claim 6, wherein the lid, body and hinge means are integrally formed from a plastic material.

13. A container according to claim 6, further comprising seating feedback means for providing a snapping type sound when the tongue edge portion is forced past the groove opening to a seated position, the feedback means indicating placement of the tongue to its seated position within the groove, thus providing assurance to the user of the interlocked arrangement between the adjoining containers.

14. A portable storage system comprising vertically stacked interlockable containers, the storage system comprising:

a first container having opposing top and bottom walls, wherein an upwardly projecting tongue extends from one of the container walls, the tongue having outwardly diverging side walls terminating in a tongue edge portion, and wherein a cavity within the opposing container wall is defined by opposing side walls converging toward a cavity opening for receiving the tongue therethrough and attaching the tongue within the cavity, the tongue and cavity each formed as an annulus extending proximate peripheral top and bottom wall edge portions, the cavity side walls generally cooperating with the tongue side walls while the tongue of the first container is attached within the cavity of a second container, the second container similar to the first container, the cavity opening being slightly smaller than the tongue edge portion, the tongue and cavity formed from material sufficiently flexible for permitting the tongue edge portion from the first container to be forced through the cavity opening of the second container; and a second container similar to the first container, the second container vertically stacked in an adjoining arrangement with the first container, the second container cavity receiving the first container tongue for coupling the first container to the second container in an interlocked, vertically stacked position.

15. A system according to claim 14, wherein the tongue extends from a bottom wall portion and the cavity is formed within the container top wall for receiving the tongue of an adjoining container, the tongue and cavity positioned for aligning side walls of the adjoining, vertically stacked container when the tongue is seated within the cavity.

16. A system according to claim 14, wherein each container is formed from a flexible plastic material.

17. A system according to claim 14, further comprising:

a lid for each container, the lid having the top wall;

a hollow body for each container, the body having an opening for receiving articles to be stored within the container, the body further having the bottom wall, the bottom wall opposing the lid top wall while the container is in a closed position, wherein the coupling positions the containers in an adjoining, interlocked arrangement during the closed position and during operation of each containers to its open position; and hinge means for each container, the hinge means operatively connected between the lid and body, the hinge means hingedly connecting the lid and body when operating the container from a closed position to and open position.

18. A system according to claim 17, wherein the hinge means comprises a continuous flexible member attached between the lid and body for permitting the lid to rotate from a closed position extending over the body opening to an open position extending away from the body opening permitting access to the hollow body through the opening, wherein at least one open lid position rotates the lid about a hinge axis through an arc of at least ninety degrees about the hinge axis.

19. A system according to claim 17, wherein the hinge means comprises:

a flap affixed to a lid peripheral portion for communicating with a boss extending from the body, the flap having bifurcated flexible projections extending in longation with flap, each projection having a hook shape end portion for securing the flap within a slot; and a boss extending from a body peripheral portion proximate the body opening, the boss having a slot for loosely receiving the flap, the projections having hook shape end portions extending outwardly for securing the flap within the boss.

20. A system according to claim 17, wherein the lid, body and hinge means are integrally formed from a plastic material.

21. A system according to claim 14, wherein a snapping sound is heard by a user when the tongue edge portion is forced past the cavity opening for indicating placement of the tongue to its seated position within the cavity, thus providing verification of the interlocked arrangement between the adjoining containers.

22. A system according to claim 14, wherein at least a portion of each container is formed from transparent material for providing a view of articles stored within the container.

* * * * *